US007389781B2

(12) United States Patent
Kemp et al.

(10) Patent No.: US 7,389,781 B2
(45) Date of Patent: Jun. 24, 2008

(54) TOOTHBRUSH ASSEMBLY

(75) Inventors: James Kemp, Somerset, NJ (US); Al Sprosta, Union, NJ (US); Brett Traficant, Clark, NJ (US); Tau Dai, Edison, NJ (US); Eduardo Jimenez, Manalapan, NJ (US); Nancy Won Mee Pak, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 225 days.

(21) Appl. No.: 10/442,905

(22) Filed: May 21, 2003

(65) Prior Publication Data

US 2004/0069317 A1 Apr. 15, 2004

Related U.S. Application Data

(63) Continuation-in-part of application No. 10/113,763, filed on Apr. 1, 2002, now abandoned.

(51) Int. Cl.
*A46B 11/00* (2006.01)
*A45D 44/18* (2006.01)

(52) U.S. Cl. ..... 132/311; 132/308; 132/309

(58) Field of Classification Search ..... 132/308–311; 15/167.1; D4/104–112; 220/371, 913
See application file for complete search history.

(56) References Cited

U.S. PATENT DOCUMENTS

| | | | | |
|---|---|---|---|---|
| 1,847,495 | A * | 3/1932 | Priest | 132/309 |
| D113,744 | S | 3/1939 | Kahn | |
| D155,668 | S | 10/1949 | Zandberg et al. | |
| 2,601,244 | A * | 6/1952 | Boulicault | 132/309 |
| D170,680 | S | 10/1953 | Del Mas | |
| D175,198 | S | 7/1955 | Tasner et al. | |
| 2,775,250 | A * | 12/1956 | Oxenrider | 132/308 |
| 2,850,753 | A * | 9/1958 | Pelletier | 15/185 |
| D209,574 | S | 12/1967 | Zandberg et al. | |
| D237,659 | S | 11/1975 | Meyer et al. | |
| 4,140,140 | A | 2/1979 | Proia et al. | |
| 4,399,723 | A * | 8/1983 | Marleau | 81/437 |
| 4,589,159 | A | 5/1986 | Streibel | |
| D329,948 | S | 10/1992 | Hanner | |
| D347,146 | S | 5/1994 | Harrison | |
| D347,147 | S | 5/1994 | Harrison | |

(Continued)

FOREIGN PATENT DOCUMENTS

| | | |
|---|---|---|
| DE | 71 43 294 | 3/1972 |

(Continued)

OTHER PUBLICATIONS

ASTM International Standard F963-96a$^{C2}$ Standard Consumer Safety Specification on Toy Safety.

(Continued)

*Primary Examiner*—Robyn Doan
(74) *Attorney, Agent, or Firm*—Michael J. Wallace, Jr.

(57) ABSTRACT

A child's toothbrush includes a handle in the form of a child-safe, ventilated toy, such as a rocket or a vehicle, and contains a removable child-safe vehicle, figurine, other toy or sundry product therein, and wherein a toothbrush head may be detachable from the handle.

21 Claims, 4 Drawing Sheets

U.S. PATENT DOCUMENTS

| | | | | | |
|---|---|---|---|---|---|
| D347,148 | S | | 5/1994 | Harrison | |
| 5,348,028 | A | * | 9/1994 | Gustavel | 132/309 |
| 5,353,464 | A | | 10/1994 | Atkins et al. | |
| 5,390,984 | A | | 2/1995 | Boucherie et al. | |
| D363,166 | S | | 10/1995 | Perrine | |
| 5,533,791 | A | | 7/1996 | Boucherie | |
| 5,590,436 | A | | 1/1997 | Wright et al. | |
| 5,609,890 | A | | 3/1997 | Boucherie | |
| 5,713,664 | A | | 2/1998 | Harilela | |
| 5,832,940 | A | * | 11/1998 | Embry et al. | 132/309 |
| 5,836,803 | A | | 11/1998 | Hamlin | |
| D402,119 | S | | 12/1998 | Landauer | |
| 5,875,796 | A | * | 3/1999 | Silver-Isenstadt et al. | 132/311 |
| 5,887,601 | A | * | 3/1999 | King | 132/311 |
| 5,909,977 | A | | 6/1999 | Kuo | |
| 5,924,429 | A | * | 7/1999 | Morando | 132/309 |
| 5,934,295 | A | | 8/1999 | Gekhter et al. | |
| 5,967,152 | A | * | 10/1999 | Rimkus | 132/308 |
| 5,968,459 | A | * | 10/1999 | Nalepa et al. | 422/300 |
| 6,015,293 | A | * | 1/2000 | Rimkus | 433/141 |
| 6,015,328 | A | | 1/2000 | Glaser | |
| 6,026,532 | A | | 2/2000 | Catanzaro | |
| 6,089,180 | A | | 7/2000 | Nichols, Jr. | |
| D434,907 | S | | 12/2000 | Landauer | |
| D443,765 | S | | 6/2001 | Porter | |
| 6,266,840 | B1 | * | 7/2001 | Munro | 15/167.1 |
| D452,380 | S | | 12/2001 | Cheong et al. | |
| D452,381 | S | | 12/2001 | Cheong et al. | |
| D452,382 | S | | 12/2001 | Cheong et al. | |
| 6,671,920 | B2 | * | 1/2004 | Pearlman et al. | 15/184 |
| 2002/0124864 | A1 | * | 9/2002 | Gross et al. | 132/311 |
| 2003/0019063 | A1 | | 1/2003 | Abraham | |

FOREIGN PATENT DOCUMENTS

| | | |
|---|---|---|
| GB | 1 408 900 | 10/1975 |

OTHER PUBLICATIONS

Claims of parent U.S. Appl. No. 10/113,763, filed Apr. 1, 2002.

* cited by examiner

TOOTHBRUSH ASSEMBLY

CROSS REFERENCE TO RELATED APPLICATIONS

The present application is a continuation-in-part of application Ser. No. 10/113,763, filed Apr. 1, 2002, now abandoned the disclosure of which being incorporated by reference herein in its entirety.

BACKGROUND OF THE INVENTION

A. Field of the Invention

The present invention relates generally to toothbrushes, and, more particularly, to a toothbrush assembly having a child-safe, ventilated, toy-shaped handle with a compartment for removably storing a separate child-safe figurine or other toy.

B. Description of the Related Art

Various types of toothbrushes having object-shaped handles are generally known in the art, and are designed to appeal to children to encourage them to brush their teeth for enhanced oral health. Examples of such toothbrushes that appeal to children include U.S. Design Pat. Nos. 237,659, 443,765, 452,381, and 452,382 disclose toothbrushes having handles shaped like vehicles (e.g., race cars, rocket ships, jets, etc.). U.S. Design Pat. Nos. 329,948, 347,146, 347,147, 347, 148, 363,166, 402,119, 434,907, and 452,380, and U.S. Pat. Nos. 5,353,464 and 6,026,532 disclose toothbrushes having handles shaped like animals. Toothbrush handles having other shapes are also possible, as seen in U.S. Design Pat. Nos. 113,744, 155,668, 175,198, and 209,574.

Many children's toys are handheld, and, especially with vehicle type handheld toys, contain a compartment with a lid for retaining figurines, such as toy people, therein. For example, the LEGO® Company of Denmark offers several vehicle type handheld toys that have a compartment with a transparent lid to retain a LEGO® figurine, such as a driver, within the vehicle. Such handheld toys are not known to have been used as toothbrush handles.

The closest the toothbrush art comes to offering toy-based handles with compartments for retaining additional figurines may be found in U.S. Pat. Nos. 5,353,464, 5,887,601, and 5,590,436 and U.S. Design Pat. No. 170,680. U.S. Pat. No. 5,353,464 discloses a toothbrush having a handle in the general form of an animal. If desired, the handle can contain a hollowed-out compartment for storage of a detachably/attachable toothbrush head. The compartment can be fitted with a suitable cover, plug, or lid to encase the entire toothbrush head within the handle. However, the compartment of U.S. Pat. No. 5,353,464 is adapted to retain only the detachable toothbrush head, and there is no mention of providing a child-safe figurine within the handle. U.S. Pat. No. 5,353,464 also fails to disclose providing a child-safe, ventilated toy-shaped handle.

Similarly, U.S. Pat. No. 5,887,601 discloses a toothbrush having a handle with a compartment. The compartment, however, is for storage of retainer rings used in dental retainer devices. U.S. Pat. No. 5,887,601 fails to disclose a toy-shaped handle, providing a figurine in the compartment, as well as a child-safe, ventilated, toy-shaped handle with a compartment for removably storing a separate child-safe figurine.

U.S. Pat. No. 5,590,436 discloses a toothbrush having a handle that carries a figurine formed separately from but attached to the handle. The figurine can be attached directly to the handle of the toothbrush or can be attached first to a carrier which is then attached to the handle. The toothbrush handle of U.S. Pat. No. 5,590,436 does not have a compartment with a cover or lid for retaining the figurine, and is not child-safe or ventilated.

U.S. Design Pat. No. 170,680 shows a figurine attached to a toothbrush handle. However, it cannot be determined whether the figurine is in a compartment formed in the toothbrush handle or is molded into a visible portion of the handle. The toothbrush handle of U.S. Design Pat. No. 170,680 does not have a compartment with a cover or lid for retaining the figurine. Thus, the reference fails to disclose a child-safe, ventilated, toy-shaped handle with a compartment for removably storing a separate child-safe figurine.

Although not part of the toothbrush art, U.S. Pat. No. 5,713,664 discloses a beverage stirrer having a pop out item such as a figurine, logo, or product replica. The pop out item can be mounted to an end of a sliding mechanism and can be configured to extend out of an open end of a casing as the beverage is stirred. Unfortunately, U.S. Pat. No. 5,713,664 fails to suggest that such a pop out item configuration can be used for a toothbrush handle.

Thus, there is a need in the art to appeal to children with a child-safe, ventilated toy-shaped toothbrush handle having a compartment and a cover or lid for removably storing a child-safe figurine or other child's toy therein, wherein the handle can function as a toy with or without a detachable toothbrush head to encourage children to brush their teeth.

SUMMARY OF THE INVENTION

The present invention solves the problems of the related art by providing a toothbrush having a head and neck which may be detachably connected to a child-safe, ventilated toy-shaped handle, such as a rocket or vehicle or figurine. The handle includes a compartment with a cover or lid for removably storing a separate child-safe vehicle, figurine, other toy or sundry product, such as candy or a miniature tube of toothpaste therein. The handle is preferably a handheld toy design that functions as a toy whether or not detached from the toothbrush head. The present invention is child-safe because neither the handle nor the figurine contained therein presents a choking hazard to children less than three years of age. The handle of the present invention is ventilated for sanitary purposes to provide rapid drying when moisture infiltrates the compartment. Ventilation prevents buildup of bacteria such as mold and mildew that accompanies stagnant moisture. The inventors of the present invention have found that such handheld toy designs, containing a compartment with an additional toy or sundry product therein, makes an ideal toothbrush handle which offers a fun, safe, sanitary, and exciting way for children to brush their teeth. Such excitement motivates children to brush their teeth often, to set in place lifelong habits of good oral hygiene.

As embodied and broadly described herein, the present invention is broadly drawn to a toothbrush assembly, comprising: a head connected to a neck, the head having an exposed outer surface; a plurality of bristles mounted to the head, the bristles being grouped into bristle tufts which extend outwardly from the exposed outer surface; a child-safe, ventilated handle connected to the neck, the handle having a ventilated compartment provided therein and an opening that provides access to the compartment; and a child-safe vehicle, figurine, other toy or sundry product removably provided within the compartment of the handle, the child-safe vehicle, figurine, other toy or sundry product being provided removably and storeably within the compartment via the opening provided in the handle.

In various practices of the present invention, the toothbrush handle takes the form of a rocket ship having a compartment and a cover or lid for retaining a child-safe figurine, such as action figure therein. Preferably, the cover is transparent so that the figurine may be viewed within the rocket ship-shaped handle. The cover may preferably be opened and closed, or removed and replaced so that the figurine may be removed and stored in the handle compartment.

In another aspect of the present invention, the toothbrush handle takes the form of a vehicle (e.g., a rescue vehicle) having a compartment and a transparent cover for retaining a figurine, such as a toy driver, therein. The transparent cover of the vehicle-shaped handle may function as a windshield for the vehicle, and may preferably be opened and closed, or removed and replaced so that the figurine may be removed and stored in the handle compartment.

In still another aspect of the present invention, the toothbrush handle may be a more conventional toothbrush shape, not the shape of a toy, but still acts as a storage and display case for the figurine contained in a compartment provided therein. An entirely transparent or translucent handle or an opaque handle with a transparent or translucent cover may be provided to enable the figurine to be displayed, and may preferably be opened and closed, or removed and replaced so that the figurine may be removed and stored in the handle compartment.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. It is to be understood that both the foregoing general description and the following detailed description are exemplary and explanatory only and are not restrictive of the invention, as claimed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF EMBODIMENTS OF THE INVENTION

Figure 4:
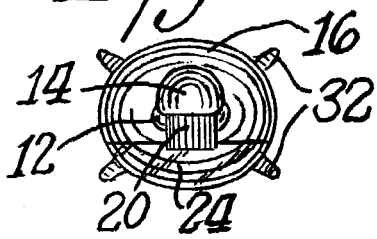
FIG. 4 is a top plan view of the toothbrush shown in FIGS. 1-3.
Figure 3:
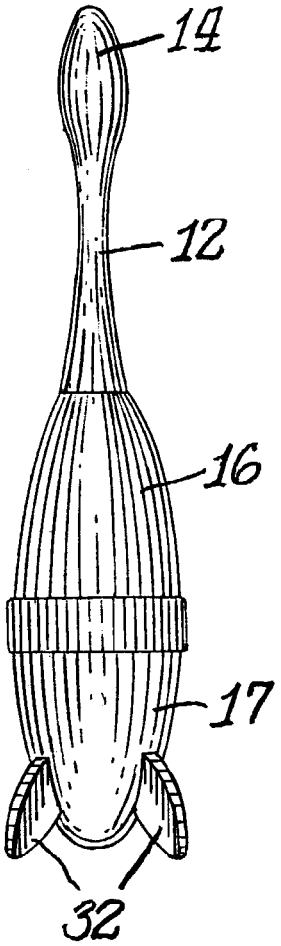
FIG. 3 is a rear elevational view of the toothbrush shown in FIGS. 1 and 2.

The following detailed description of the invention refers to the accompanying drawings.

The same reference numbers in different drawings identify the same or similar elements. Also, the following detailed description does not limit the invention. Instead, the scope of the invention is defined by the appended claims and equivalents thereof.

FIGS. 1-5 illustrate one practice of the present invention wherein a toothbrush 10 includes a neck section 12 interposed between a head 14 and a handheld handle 16. Preferably, neck 12 and head 14 are integrally connected, and together are detachably connected to handle 16 so that head 14 may be replaced as the bristles become worn and so that handle 16 may function separately as a toy when detached from neck 12 and head 14. In an alternate, less costly embodiment of the present invention, the head 14 and neck 12 are integral and permanently connected to the handle 16.

As further shown in FIGS. 1-5, handle 16 preferably includes a hollowed-out compartment 22 with a cover, window, or lid 24 for retaining a figurine 28, such as an action figure; however, it is understood that in place of the figurine may be a vehicle, such as a submarine, plane or other toy or sundry product, such as candy or a miniature toothpaste tube which will appeal to a child. Cover 24 may be hinged or otherwise fixedly attached to, such as by being removably snapped thereto, or integrally formed with a body portion 17 of handle 16 and may be transparent for displaying figurine 28 housed within compartment 22. Although cover 24 may be configured to be removable, if cover 24 is fixedly attached to handle 16, an access opening for compartment 22 should be provided where neck 12 connects to handle 16 (as described more fully below with reference to FIG. 11). An indicia band 30 may additionally be provided for displaying a toy logo. Since the embodiment of the handle 16 shown in FIGS. 1-5 is shaped like a rocket ship, it preferably includes fins 32 which simulate rocket ship fins, but also act as support feet for holding toothbrush 10 in an upright position for easy storage or display.

Figure 5A:
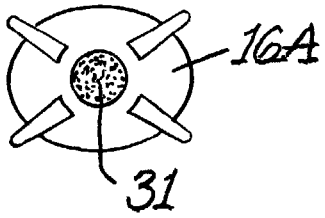
FIG. 5A is an alternative bottom plan view of the toothbrush shown in FIGS. 1-4 and showing an alternative mechanism to provide ventilation to the toothbrush handle.
Figure 5:
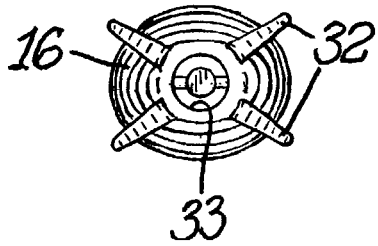
FIG. 5 is a bottom plan view of the toothbrush shown in FIGS. 1-4.

FIG. 5 further shows that ventilation may be provided to compartment 22 by forming openings 33 at the bottom of body portion 17. Openings 33 may be in the form of perforations, slots, slits, holes, etc. formed through the material making up body portion 17. Openings 33 maybe provided at other locations of body portion 17 and/or may be formed in cover 24. Such ventilation would permit compartment 22 to rapidly air dry when moisture, atmospheric particles (e.g., food particles), and organisms enter the compartment 22. Moisture, particles, and organisms create an unsanitary environment if they are not rapidly air dried. Thus, openings 33 provide sanitary protection to compartment 22 by preventing moisture, particles, and organisms from accumulating in compartment 22.

Alternatively, as shown in FIG. 5A, openings 33 may be replaced with a breathable membrane 31 or a plurality of such membranes 31 formed at the bottom of body portion 17. Breathable membranes 31 may be provided at other locations of body portion 17 and/or may be provided in cover 24. Breathable membranes 31 may be made of a material such as the material sold under the trademark GORE-TEX or another equivalent material. Such material allows air and water vapor to move across it, but does not allow water in liquid form to move across it. If moisture enters compartment 22 through, for example, removable cover 24, breathable membranes 31 would permit compartment 22 to rapidly air dry as well as prevent water in liquid form from entering compartment 22. Any combination of ventilation openings 33 and breathable membranes 31 may also be provided in body portion 17 and/or cover 24.

Ventilation openings 33, breathable membranes 31, and/or combinations thereof may be provided in the other embodiments of the toothbrush assembly of the present invention, as shown in FIGS. 6-15 and discussed below.

Figure 6:
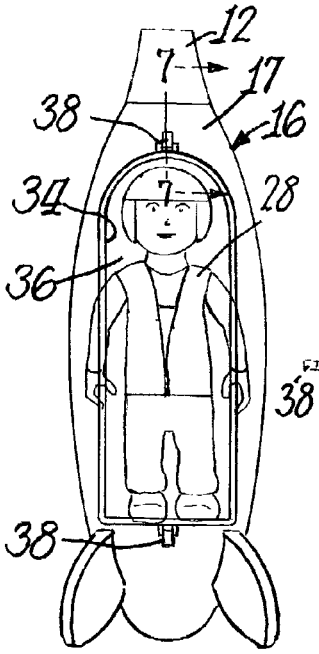
FIG. 6 is a front elevational view of the toothbrush handle shown in FIGS. 1-5, and showing a removable and replaceable cover held in place by a snap-in latch.
Figure 7:
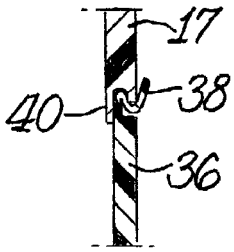
FIG. 7 is a cross-sectional view in elevation of the toothbrush handle shown in FIGS. 1-6, taken along line 7-7 of FIG. 6 and showing a snap-in latch provided in a receiver recess.

FIGS. 6-10 show various ways an openable cover may be arranged over an opening provided in a body portion 17 of handle 16, as opposed to the fixedly attached cover 24 shown in FIGS. 1-5. FIG. 6 shows a handle body portion 17 with an opening 34 provided therein for receiving a removable and replaceable cover 36 held in place by two snap-in latches 38. Snap-in latches 38 are received and retained in respective receptacles 40 formed in body portion 17 of handle 16, as best shown in FIG. 7. Latches 38 may be engaged to remove cover 36 from opening 34, permitting removal or insertion of figurine 28 from or within compartment 22 of handle 16.

Figure 8:
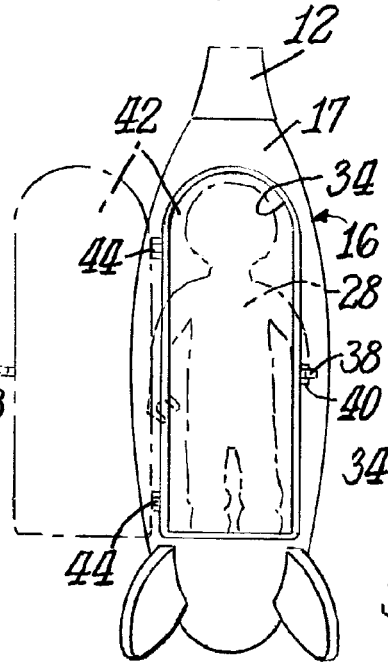
FIG. 8 is a front elevational view of the toothbrush handle shown in FIGS. 1-5, and showing an alternative embodiment with a hinged full cover with a snap-in latch.

FIG. 8 shows a handle body portion 17 with an opening 34 provided therein for receiving a cover 42 hingedly connected to body portion 17 with a pair of hinges 44. A snap-in latch 38 is provided on an edge of cover 42 opposing the edge attached to hinges 44. Snap-in latch 38 may be received and retained in a receptacle 40 formed in body portion 17. Latch 38 may be engaged to pivot cover 42 away from opening 34, permitting removal or insertion of figurine 28 from or within compartment 22 of handle 16.

Figure 9:
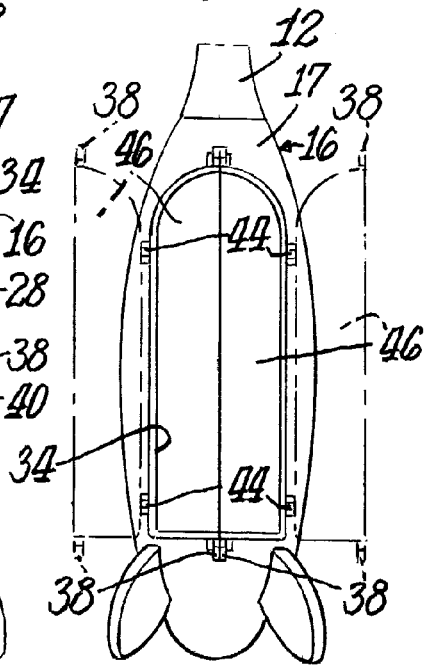
FIG. 9 is a front elevational view of the toothbrush handle shown in FIGS. 1-5, and showing another alternative embodiment with a vertically-hinged two-piece cover with snap-in latches for each removable and replaceable cover.

FIG. 9 shows a handle body portion 17 with an opening 34 provided therein for receiving a two-piece cover 46 hingedly connected in a vertical direction to body portion 17 with two pairs of hinges 44. Snap-in latches 38 are provided on an edge of each piece of cover 46 opposing the edge attached to hinges 44. Snap-in latches 38 may be received and retained in respective receptacles 40 formed in body portion 17. Latches 38 may be engaged to pivot two-piece cover 46 away from opening 34, permitting removal or insertion of figurine 28 from or within compartment 22 of handle 16.

Figure 10:
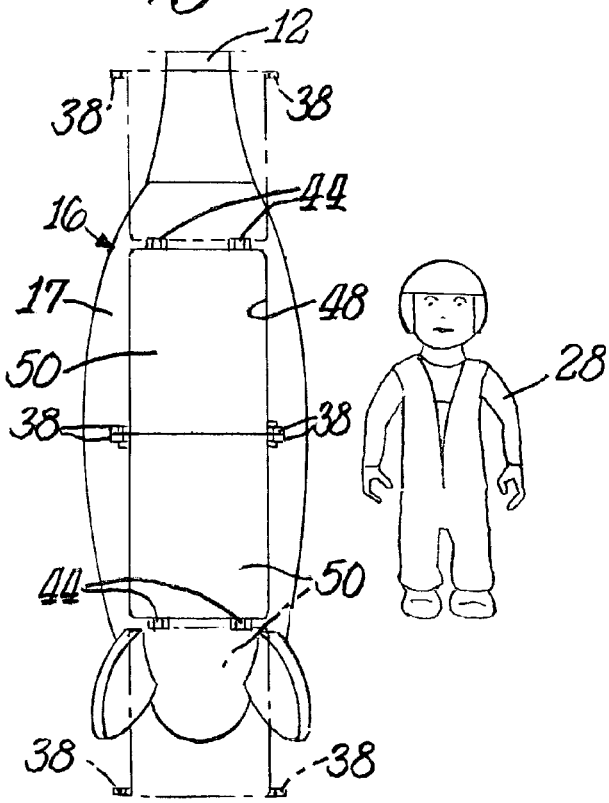
FIG. 10 is a front elevational view of the toothbrush handle shown in FIGS. 1-5, and showing still another alternative embodiment with a horizontally-hinged two-piece cover with snap-in latches for each removable and replaceable cover and a figurine removed from the compartment of the toothbrush handle.

FIG. 10 shows a handle body portion 17 with an opening 48 provided therein for receiving a two-piece cover 50 hingedly connected in a horizontal direction to body portion 17 with two pairs of hinges 44. Snap-in latches 38 are provided on an edge of each piece of cover 50 opposing the edge attached to hinges 44. Snap-in latches 38 maybe received and retained in respective receptacles 40 formed in body portion 17. Latches 38 may be engaged to pivot two-piece cover 50 away from opening 34, permitting removal or insertion of figurine 28 from or within compartment 22 of handle 16.

Although hinges 40 and latches 38 are shown in specific quantities and at specific locations in FIGS. 6-10, more or less hinges 40 and latches 38 may be provided, at a variety of locations on handle 16 in accordance with the broad teachings of the present invention. Likewise, the covers shown in FIGS. 6-10 may have a variety of other shapes than shown in FIGS. 6-10, in accordance with the broad teachings of the present invention. Furthermore, other mechanisms may be used to connect and pivot the covers to the handles of the present invention.

Figure 11:
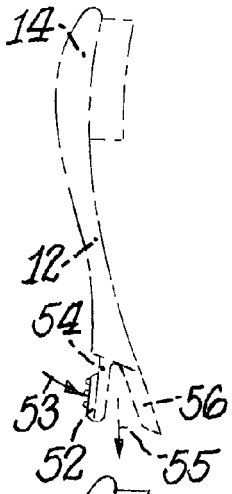
FIG. 11 is a side elevational view of a toothbrush having a removable head and neck (shown in phantom outline) and a vehicle-shaped handle having a removable and replaceable cover displaying a compartment that removably stores a figurine therein in accordance with still another embodiment of the present invention.
Figure 12:
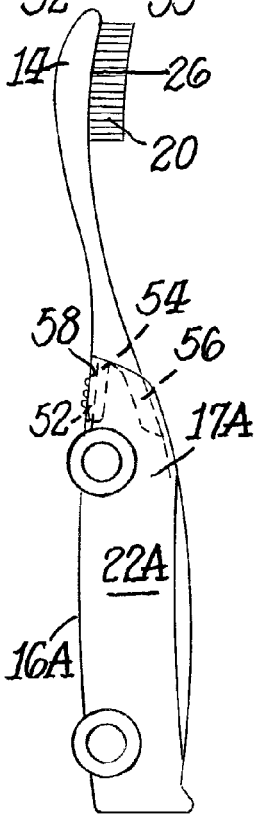
FIG. 12 is a front elevational view of the toothbrush shown in FIG. 11.
Figure 12:
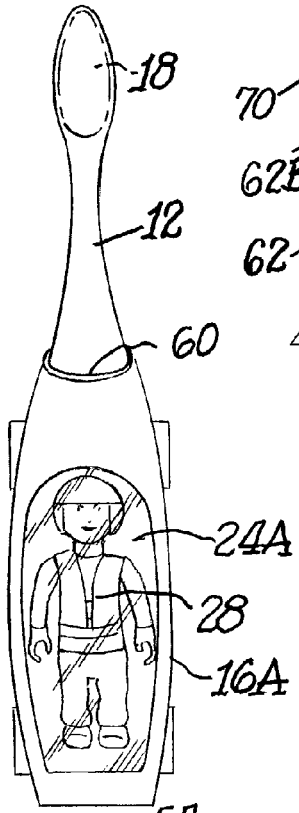
Figure 13:
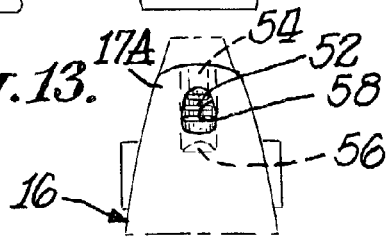
FIG. 13 is a fragmental rear view of the toothbrush shown in FIGS. 11 and 12, and showing how a retainer button of the toothbrush neck engages a retainer slot formed in the handle.

FIGS. 11-13 show one version of how neck 12 and head 14 of toothbrush 10 may be removably connected to the handle of toothbrush 10. An alternate version of handle 16A is also shown in FIGS. 11-13. Handle 16A as shown may be shaped like a vehicle, such vehicles may include a race car, a submarine or an all terrain vehicle and includes a body portion 17A fixedly connected to or integrally formed with a transparent cover or window 24A. Window 24A displays a figurine 28, such as an action figure, that maybe provided in a compartment 22A provided in handle 16A.

As further shown in FIGS. 11-13, a lower portion of neck 12 includes a retainer button 52 integrally connected to a spring arm 54, and a stiffener arm 56. Neck 12 and head 14 may be removably attached to handle 16A by depressing retainer button 52 in a direction as shown by arrow 53, moving neck 12 in a direction as shown by arrow 55, sliding stiffener arm 56 and the button 52/spring arm 54 combination into an opening 60 provided in body portion 17A of handle 16A, and releasing retainer button 52. Retainer button 52 extends through a retainer slot 58 provided in body portion 17A, and remains in slot 58 due to the spring force provided by spring arm 54. Neck 12 and head 14 may be removed from handle 16A by depressing retainer button 52, and pulling neck 12 and head 14 away from handle 16A.

Figure 14:
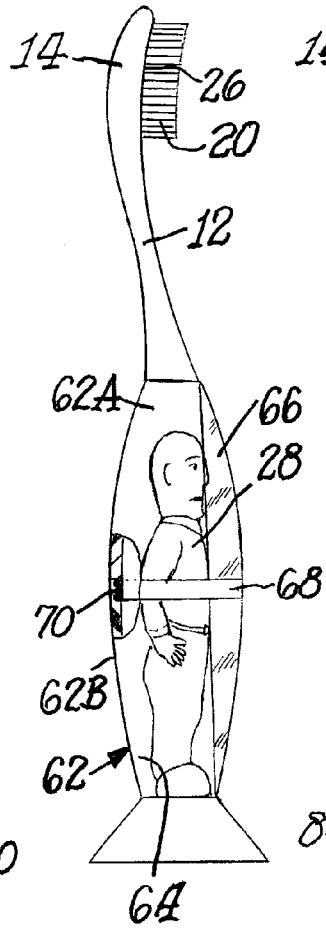
FIG. 14 is a side elevational view of a toothbrush having a removable head and neck, and a handle having a cover displaying a compartment that stores a figurine therein in accordance with still another embodiment of the present invention.
Figure 15:
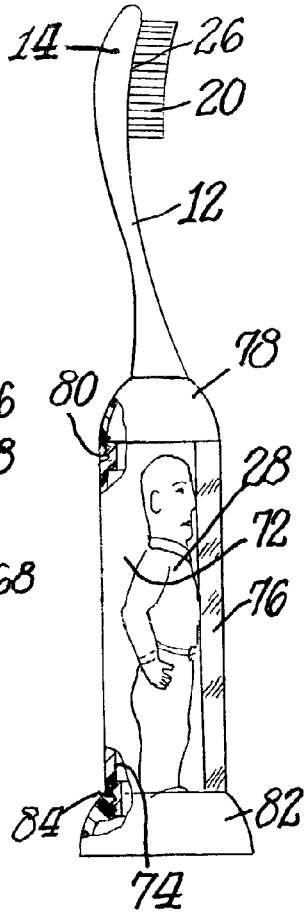
FIG. 15 is a side elevational view of still another embodiment of a toothbrush of the present invention having a removable head and neck, and a handle having a cover displaying a compartment that stores a figurine therein.

As shown in FIGS. 14 and 15, the handle of the present invention need not be shaped like a toy, but rather may be configured as a conventional generally cylindrical toothbrush handle to act as display case for figurine 28 contained therein. As shown in FIG. 14, toothbrush 10 includes a neck section 12 interposed between a head 14 and a handheld display handle 62. Handle 62 preferably includes a hollowed-out compartment 64 with a transparent window 66 for retaining a figurine 28 (e.g., an action figure) therein. In this embodiment, handle 62 includes two separate sections, a top section 62A and a bottom section 62B, which are threadably connectable with an indicia band 68 (similar to indicia band 30), via mating threads 70 provided on indicia band 68 and sections 62A, 62B. When top section 62A or bottom section 62B is unscrewed from indicia band 70, figurine 28 may be removed from or inserted in compartment 64 of handle 62.

As shown in FIG. 15, toothbrush 10 includes a neck section 12 interposed between a head 14 and a handheld display handle 72. Handle 72 preferably includes a hollowed-out compartment 74 with a transparent window 76 for retaining a figurine 28 (e.g., an action figure) therein. In this embodiment, handle 72 either threadably connects with a screw off top 78 (having neck 12 connected thereto), via mating threads 80, threadably connects with a screw off base 82, via mating threads 84, or threadably connects with screw off top 78 and screw off base 82. When screw off top 78 or screw off base 82 are unscrewed from handle 72, figurine 28 may be removed from or inserted in compartment 74 of handle 72.

Any embodiment of the toothbrush handles 16, 16A, 62, 72 of the present invention may be permanently attached to neck 12 and head 14, or may be removably attached to neck 12 or head 14 using any of the attachment configurations shown in FIGS. 11-15. Preferably, however, the toothbrush handles of the present invention are removably attached to neck 12 and head 14 so that the handles may function more easily as a separate toy.

Figure 16:
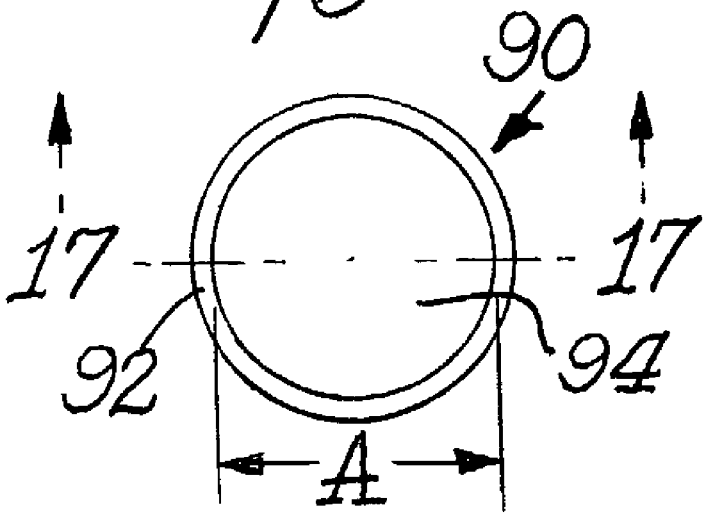
FIG. 16 is a top plan view of a small parts cylinder in accordance with ASTM International Standard F963-96a$^{\epsilon 2}$ Standard Consumer Safety Specification on Toy Safety, representing the size requirements for toys including the toothbrush handle and figurine of the present invention.
Figure 17:
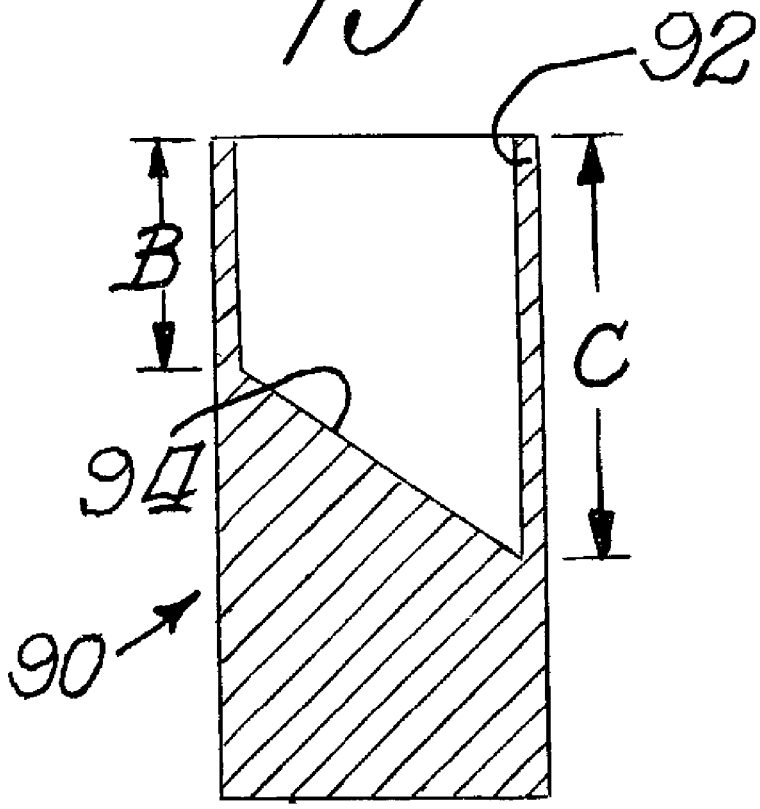
FIG. 17 is a cross-sectional side view of the small parts cylinder taken along line 17-17 of FIG. 16.

Preferably, handles 16, 16A, 62, 72 and figurines 28 of the present invention are "child-safe". As used herein, the term "child-safe" shall mean that handles 16, 16A, 62, 72 and figurines 28 are of large enough dimensions that they are not choking hazards to children less than three years of age, as set forth in ASTM International Standard F963-96a$^{\epsilon 2}$ Standard Consumer Safety Specification on Toy Safety ("ASTM F963-96a$^{\epsilon 2}$"). Section 4.6.1 of ASTM F963-96a$^{\epsilon 2}$ requires, in part, that no toy (including removable liberated components, or fragments of toys) shall be small enough without being compressed to fit entirely within a cylinder 90 of the specified dimensions as shown in FIGS. 16 and 17. As shown in FIGS. 16 and 17, cylinder 90 includes a wall 92 and a sloped bottom surface 94. Cylinder 90 also has a 1.25-inch inner diameter A, and two heights—a shorter height B of 1.00 inches and a longer height C of 2.25 inches, as defined by sloped bottom surface 94. Thus, handles 16, 16A, 62, 72 and figurines 28 should have dimensions large enough that they do not entirely fit, without being compressed, into the cylinder 90 shown in FIGS. 16 and 17.

Head 14 of the present invention may have a generally flat face 18 that holds a plurality of tufts or bristles 20. Head 14 may have variety of shapes, including but not limited to circular, oval, square, rectangular, various regular or irregular shapes, etc.

Figure 2:
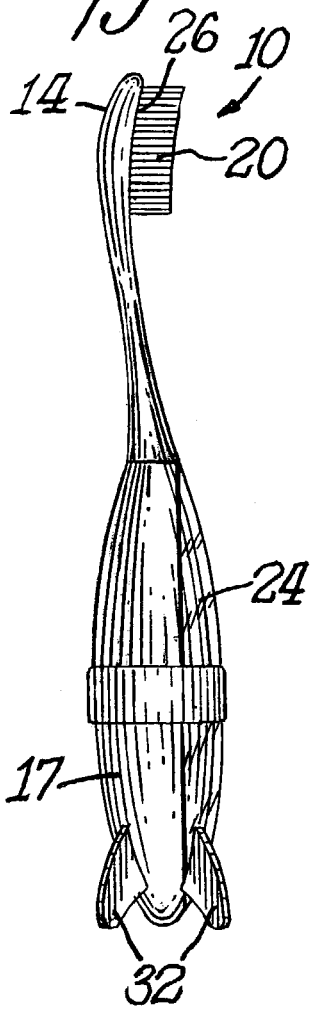
FIG. 2 is a side elevational view of the toothbrush shown in FIG. 1.
Figure 1:
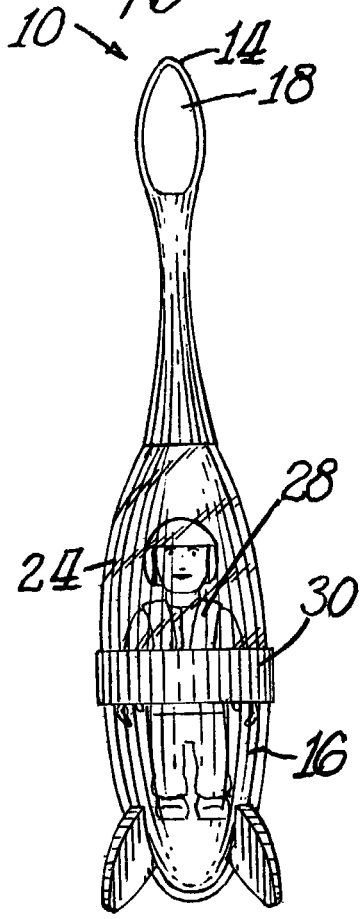
FIG. 1 is a front elevational view of a toothbrush having a head and a rocket ship-shaped handle having a removable and replaceable cover that allows access to a compartment for storing a figurine therein in accordance with an embodiment of the present invention.

Bristles 20 extending from face 18 may be coplanar with each other so that the outer surface of bristles 20 lie in a single plane. The invention, however, could be practiced where some or all of the bristles 20 extend outwardly a different distance than other bristles 20 to result in a stepped effect for the outer surface of bristles. In the illustrated embodiment as best shown in FIG. 2, bristles 20 extend outwardly from an outer surface 26 of head 14 approximately the same distance to create a generally flat surface or flat bristle trim for receiving the toothpaste.

While FIGS. 2, 4, 11, 14, and 15 illustrate conventional fiber form bristles, the term "bristles" as used herein is intended to be used in a generic sense as cleaning elements or massage elements and could include, for example, elastomeric fingers or walls arranged in a circular cross-section shape or any type of desired shape, including straight portions or sinusoidal portions.

The bristles 20 could be mounted to the tuft blocks or sections by extending through suitable openings in face 18 so that the base of bristles 20 is mounted within or below the surface of face 18 using conventional staple or in-mold tufting technology for mounting therein. If desired, the bristles could be embedded in an elastomeric material which would permit the bristles to have an independent motion. Such various forms of bristles may thus be used for the bristles used in any section of head 14.

It is to be understood that the specific illustration of the bristles is merely for exemplary purposes. The invention can, however, be practiced with various combinations of the same or different bristle configurations as disclosed in U.S. Pat. Nos. 5,609,890, 5,390,984, and 5,533,791, the disclosures of which being incorporated by reference herein in their entirety, and/or with the same or different bristle materials, such as nylon bristles, spiral bristles, rubber bristles, etc. Similarly, while FIGS. 1-7 illustrate the bristles to be generally perpendicular to face 18 of head 14, some or all of the bristles may be angled at various angles with respect to the outer surface of the bristle head. It is thereby possible to select the combination of bristle configurations, bristle materials and bristle orientations to achieve specific intended results, such as to create as much movement from the oscillating tuft heads to deliver additional oral health benefits like enhanced cleaning, tooth polishing, tooth whitening and/or massaging of the gums.

It is to be understood that the invention can be practiced by locating tufts of bristles in any otherwise open area of toothbrush head 14. Such tufts of bristles could be fixed bristles perpendicularly mounted or mounted at an angle to the exposed outer surface 26 of the head 14 or could be bristles mounted on an elastomeric base with a Shore A durometer in the range of about 0 to about 90, so as to be independently movable when pressure is applied. Such bristles in their normal condition could be either perpendicular or at an angle to the face 18 of head 14.

The invention may also be practiced where different sets of bristles have different colors. It is to be understood, however, that any combination of colors including only one color could be used for bristles 20. Likewise, neck 12 and handle 16 may have a variety of colors, and may be opaque, transparent, translucent, clear, etc.

What is claimed is:

1. A toothbrush assembly, comprising: a head connected to a neck, said head having a plurality of bristles extending outwardly therefrom; a handle connected to said neck, said handle having a ventilated compartment provided therein; and a vehicle, figurine, other toy or sundry product being provided in the compartment; wherein at least one breathable membrane is provided in the handle to ventilate the compartment, the breathable membrane configured such that a first side of the membrane forms an interior surface of the ventilated compartment and a second side of the membrane forms an exterior surface of the ventilated compartment thereby enabling the ventilated compartment to be ventilated by an environment external to the toothbrush assembly; wherein the compartment has a cover being articulated in which the cover may be opened and re-closed whereby said vehicle, figurine, other toy or sundry product may be removed and replaced in the compartment; wherein the handle includes a plurality of supports positioned so as to surround the breathable membrane of the handle and to hold the toothbrush in an upright position, and an opaque portion; wherein the cover is transparent to permit viewing of the vehicle, figurine, other toy or sundry product, the cover being disposed in an opening in the opaque portion along a longitudinal axis of the handle.

2. A toothbrush assembly as recited in claim 1, wherein at least one opening is provided in the handle to ventilate the compartment.

3. A toothbrush assembly as recited in claim 1, wherein at least one opening is provided in the cover to ventilate the compartment.

4. A toothbrush assembly as recited in claim 1, wherein at least one breathable membrane is provided in the cover to ventilate the compartment.

5. A toothbrush assembly as recited in claim 1, wherein at least one opening and at least one breathable membrane are provided in the cover to ventilate the compartment.

6. A toothbrush assembly as recited in claim 1, wherein said handle is in the shape of a rocket ship.

7. A toothbrush assembly as recited in claim 1, wherein said handle is in the shape of a vehicle.

8. A toothbrush assembly as recited in claim 1, wherein said handle is in the shape of a display case.

9. A toothbrush assembly as recited in claim 1, wherein said neck removably connects to said handle.

10. A toothbrush assembly as recited in claim 9, wherein said neck retains said figurine within the compartment.

11. A toothbrush assembly as recited in claim 9, wherein a lower portion of said neck includes a stiffener arm and a retainer button integrally connected to a spring arm, the retainer button, spring arm, and stiffener arm removably connected to the opening of said handle.

12. A toothbrush assembly as recited in claim 11, wherein the retainer button extends through a retainer slot provided in said handle, and remains in the retainer slot due to a spring force provided by the spring arm.

13. A toothbrush assembly as recited in claim 1, wherein the cover permanently connects to said handle.

14. A toothbrush assembly as recited in claim 1, wherein the cover removably connects to said handle via at least one snap-in latch.

15. A toothbrush assembly as recited in claim 1, wherein the cover connects to said handle with at least one hinge and at least one snap-in latch.

16. A toothbrush assembly as recited in claim 15, wherein the cover comprises two pieces, each cover piece connecting to said handle via at least one hinge and at least one snap-in latch.

17. A toothbrush assembly as recited in claim 1, wherein said handle comprises two sections connected together with an indicia band.

18. A toothbrush assembly as recited in claim 17, the indicia band has threads that mate with threads provided on each section of said handle.

19. A toothbrush assembly as recited in claim 1, wherein a top end of said handle threadably connects to a screw off top integrally connected to said neck, the screw off top providing access to the opening of said handle.

20. A toothbrush assembly as recited in claim 19, wherein a bottom end of said handle threadably connects to a screw off base, the screw off base providing access to another opening of said handle.

21. A toothbrush assembly as recited in claim 1, wherein a bottom end of said handle threadably connects to a screw off base, the screw off base providing access to the opening of said handle.

* * * * *